United States Patent [19]

Moss

[11] Patent Number: 4,940,098

[45] Date of Patent: Jul. 10, 1990

[54] REVERSE CIRCULATION DRILL ROD

[76] Inventor: Daniel H. Moss, 6942 E. Redbud Rd., Tucson, Ariz. 85715

[21] Appl. No.: 357,117

[22] Filed: May 26, 1989

[51] Int. Cl.[5] ..... E21B 17/18

[52] U.S. Cl. ..... 175/320; 175/321; 138/113; 138/114; 285/133.1; 285/133.2; 285/134

[58] Field of Search ..... 175/215, 320, 321; 285/133.1, 133.2, 134, 136; 138/113, 114; 166/242

[56] References Cited

U.S. PATENT DOCUMENTS

| | | | |
|---|---|---|---|
| 1,547,461 | 7/1925 | Steele . | |
| 2,786,652 | 3/1957 | Wells | 255/24 |
| 2,849,214 | 8/1958 | Hall | 255/24 |
| 3,077,358 | 2/1963 | Costa | 285/133 |
| 3,280,925 | 10/1966 | Becker et al. | 175/58 |
| 3,297,100 | 1/1967 | Crews | 175/195 |
| 3,489,436 | 1/1970 | McClure | 285/133 |
| 3,552,779 | 1/1971 | Henderson | 285/133.1 |
| 3,664,441 | 5/1972 | Carey | 175/215 |
| 3,664,443 | 5/1972 | Campbell | 175/293 |
| 3,786,878 | 1/1974 | Chapman | 175/320 |
| 3,807,514 | 4/1974 | Murrell | 175/195 |
| 3,998,479 | 12/1976 | Bishop | 285/133.2 |
| 4,012,061 | 3/1977 | Olson | 285/133.2 |
| 4,067,596 | 1/1978 | Kellner et al. | 175/215 |
| 4,691,790 | 9/1987 | Reichman et al. | 175/67 |

*Primary Examiner*—Bruce M. Kisliuk

*Attorney, Agent, or Firm*—J. Michael McClanahan

[57] ABSTRACT

A reverse circulation drill rod of the dual tube type having a pin and box at opposite ends with a floating inner tube concentrically situated, the inner tube permitted longitudinal freedom of movement. A plurality of inwardly protruding radial directed lands adapted to encompass and align the inner tube are contained within each box and pin. Compression springs attached to the inner tube residing interiorly to the outer tube provide the longitudinal freedom of movement within limits. As the sections of drill rod are assembled vertically during operation, freedom of lengthwise movement by the inner tube allows stacking of the inner tubes in order that a seal be achieved between the square ends of each inner tube section. Compressed air or liquid is forced down the cylindrical space annulus formed between the outer tube and the inner tube, and drill bit grindings or rock fragments, together with the fluid, is brought to the ground surface in the conduit provided by the inner tube for simultaneous analysis.

11 Claims, 1 Drawing Sheet

REVERSE CIRCULATION DRILL ROD

BACKGROUND OF THE INVENTION

1. Field of the Invention

The field of the invention is drill rod apparatus used in mineral exploratory type borehole drilling employing double wall drill tubes to recover grindings and cuttings for analysis from the bottom of the borehole.

2. Description of the Related Art

In the field of the invention it is necessary to drill exploratory boreholes in areas of expected mineralization to obtain data relating to the presence and concentration of an ore body or potential ore body. To this end, information must be known concerning the ore products encountered by the drill bit relative to its depth below the ground surface. Several types of methods are available for obtaining such data. For example, core samples of the earth may be obtained through the means of rotary diamond drilling wherein an annular elongated cylinder is drilled leaving a resultant solid cylindrical core which is then brought to the surface for analysis by raising the drill rod and bit. Such method is, in addition to being slow and tedious, very expensive. Other methods of exploratory earth boring are available, such as drilling a borehole utilizing a rotary bit and concurrently bringing to the surface the cuttings or grindings resulting from the drilling process as the process is continuing. Such a method provides continuous analysis as the drilling progresses.

In addition, a borehole may be sunk by percussion drilling wherein fragments of the portion of the earth being hammered by the drill rod bit are loosened and simultaneously brought to the surface for analysis.

The drill rod for accomplishing methods of earth boring wherein rock fragments or drill cuttings and grindings are brought to the surface for analysis without the need for raising the drill rod is the aim of the subject inventive reverse circulation drill rod.

More particularly, it is known to use dual wall or double wall tubular concentric drill rod as the means for transmitting torque to the rotary bit, or air to a percussion core bit, while at the same time bringing up the rock fragments and drill cuttings. This is accomplished for both cases by injecting a fluid in the cylindrical space annulus between the two concentric tubes (the outer tube and the inner tube) at the ground surface, the fluid then pumped, under pressure, to the area of the rotary bit or percussion core bit at the lower end of the drill rod. Then the rock fragments or cuttings are removed to the ground surface by the injected fluid as the rock fragments and bit grindings are generated. These fragments or grindings are transmitted through the conduit provided by the inner tube, sometimes referred to as an exit tube. Either a liquid or gas may be used as the fluid.

Connecting sections or stands of the outer tube are pins and boxes, each outer tube section having a threaded pin at one end and a threaded box at the other, the tube sections adapted to be joined together to form long lengths of drill rod by connecting pins with boxes. Typically, a section may be 10 to 25 feet in length.

Problems which have been encountered in reverse circulation drill rods are restrictions to the flow of fluid downward in the outer cylindrical space annulus between the outer and inner tubes caused in many cases by the fluid attempting to get through the pins and boxes at each end of the outer tube and by the various schemes by which the inner tube is attached to the pin and box in each stand of drill rod. In addition, each pin and each box must align the inner tube so that it operably connects to the inner tube in the next section of the drill rod with minimal opportunity for loss of the fluid containing the rock fragments or bit cuttings moving interiorly upward through the inner tube, or the escape of fluid into the inner tube from the cylindrical space annulus at the inner tube joints as the fluid is being pumped downward in the drill rod.

In the past, it has been common to utilize schemes wherein the inner tube sections residing in each outer tube stand or section is butt joined with a resilient seal. However, disadvantages of using a separate seal at the inner tube joint are that in many cases these seals will be damaged in the process of inserting them between the sections of inner tube, and because each seal must be separately placed between the sections of inner tube, the process becomes very time consuming and adds considerably to the cost of drilling.

In addition, for those types of reverse circulation drill rod which have inner tubes joined by threading sections of inner tube together, in many cases, to assure a fit between inner tubes, the threads on the inner tube must be indexed with the threads on the pin and box. In addition, it is readily apparent that if the outer tube and the inner tube are fixed lengths, placement of the pin and the box upon the outer tube must be precise in order that the length of the outer tube plus its pin and box must be precision related to the length of the inner tube. Otherwise, the threads, although indexed as to where each rotationally starts, may not be engaged simultaneously, and insufficient sealing between inner tubes will result if there are variances between each length of the outer tube plus its pins and boxes and the inner tube. Such variances will result in inadequate sealing of the joints of the inner tube.

Thus it is apparent that it would be useful to provide a reverse circulation drill rod section which provides for longitudinal freedom of the inner tube relative to the outer tube and its box and pin where, in connecting multiple lengths, of the drill rod, errors in inner tube length or outer tube and its box and pin lengths tend to compensate for each other while not requiring resilient seals between each section of inner tube.

Accordingly, there would be an advantage of providing such a reverse circulation drill rod sections which permits movement of the inner tube relative to the outer tube for purposes of attaching one drill rod section to another, while also providing minimum resistance to travel of fluid down through the cylindrical space annulus of the drill rod sections. In addition, having such drill rod sections so constructed as to require minimum effort and time on the part of the operators in connecting one section to another would also be obviously advantageous.

SUMMARY OF THE INVENTION

This invention relates to a novel reverse circulation drill rod section or stand which provides in each section of a drill rod an inner tube which floats interiorly to the outer tube, i.e., has longitudinal freedom of movement within limits; which provides alignment of inner tubes from drill rod section to drill rod section; which provides minimal restriction to the passage of fluid in the cylindrical space annulus between the inner tube and the outer tube; which compensates for errors which might be present in the length of the inner tube relative to the length of the outer tube and its connected pin and box; and which obviates the need for resilient seals between each length of inner tube.

More particularly, the subject invention comprises, in part, elongated cylindrical pins and boxes for attachment at opposite ends of an outer tube section, the pin having at one end a reduced diameter exterior cylindrical surface neck adapted to be encompassed by one end of the outer tube, with the other end of the pin also having a reduced diameter exterior cylindrical surface with male type threads, the threaded end adapted to be received in a female type threaded end of a box. The pin is further characterized as having a plurality of inwardly protruding radially directed lands emerging from an internal cylindrical bore, the lands adapted to receive for holding and aligning the inner tube situated concentrically throughout the total length of the outer tube plus its pin and box at each end. By such alignment of the inner tube, as the various sections of the drill rod comprising outer and inner tubes and connecting pin and box, are joined, there is minimal leakage through the inner tube joints.

At the end opposite the end of the outer tube with the pin is the box comprising also an elongated cylinder having an outer cylindrical circular surface and an internal cylindrical bore, the box, like the pin, having at one end a reduced diameter cylindrical surface neck adapted to receive the end to the outer tube in a sleeve-like fashion opposite the end of the outer tube having the pin. Both pin and box are fixedly attached to the outer tube by means of an annular weld fillet which attaches the circular rim surface of the outer tube to the pin or box sloped shoulder differentiating the reduced circular diameter neck portion of the box or pin and the full diameter cylindrical surface. At the opposite end of the box, the internal cylindrical bore is female threaded, the threads adapted to receive the threads of the pin in order that the pin and the box may be fixedly joined to assemble the sections of the drill rod or to separate when disassembling.

Like with the outer tube-pin relationship, the inner tube passes through the interior cylindrical bore of the box. Also, similarly to the pin, the internal cylindrical bore of the box is characterized by a plurality of inwardly protruding radially directed lands which receive the outer surface of the inner tube for holding and alignment with the inner tube of the next section. For both pin and box, interstices or spaces between the plurality of lands provide air passageways to connect the cylindrical space annulus passageway situated between the outer and the inner tubes.

Holding the inner tube interiorly to each section of drill rod, but holding with longitudinal freedom of movement, are a pair of compression springs situated in the cylindrical space annulus, one placed at each end of the drill rod section. Each spring is attached to the inner tube by means of a lug, the lug welded to the outside surface of the inner tube, and the spring in turn is welded to the lug. The spring, which nominally comprises one to two coils, has an outside coil diameter of no larger than the interior diameter of the outer tube. The lug is situated on the inner tube at a point where one or slightly less than one turn of each coil spring is allowed to engage the interior circular junction of the pin (or box) with the outer tube, thus both springs are placed into a slight compressed state as they are engaged by the pin and box.

Thus, the inner tube may be said to be spring loaded interiorly to the outer tube and its connecting pin and box such that limited freedom of longitudinal movement is allowed the inner tube within each section of drill rod. The circular rim of each end of each inner tube is precision ground square and flat so that as each section of inner tube mates, no opportunity is provided for leakage across the resultant butt joint.

It is an object of the subject invention to provide sections of reverse circulation drill rod with an inner tube contained within each section of outer tube and connecting box and pin.

It is another object of the subject invention to provide sections of reverse circulation drill rod wherein each section of the inner tube is precisely aligned for butt connection to the inner tube of adjacent drill rod sections.

It is still another object of the subject invention to provide sections of reverse circulation drill rod wherein the inner tube is provided longitudinal freedom of movement, within limits, in order to assure connection with adjoining drill rod section inner tubes.

Other objects of the invention will in part be obvious and will in part appear hereinafter. The invention accordingly comprises the apparatus and method comprising construction, combination of elements, and arrangement of parts which are exemplified in the following detailed disclosure and the scope to the application which will be indicated in the claims.

BRIEF DESCRIPTION OF THE DRAWINGS

For further understanding of the nature and objects of the present invention, reference should be had to the following detailed description taken in connection with the accompanying drawing wherein.

In various views, like index numbers refer to like elements.

DETAILED DESCRIPTION OF THE PREFERRED EMBODIMENT

Figure 1:
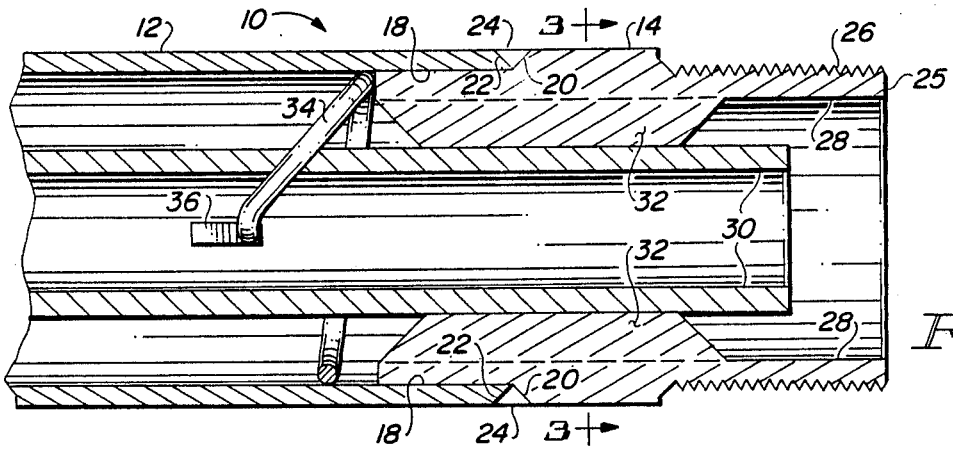
FIG. 1 is a cross-sectional view of the pin end of a reverse circulation drill rod section.
Figure 2:
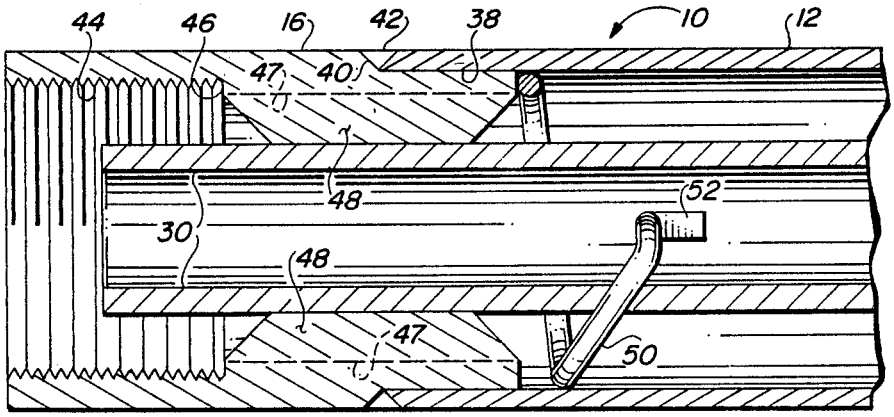
FIG. 2, is a cross-sectional view of the box end of a reverse circulation drill rod section.

Referring now to FIG. 1, a cross-sectional view is shown of a portion of the pin end of the subject reverse circulation drill rod 10 with the floating inner tube centrally situated. Firstly, outer tube 12, which is supplied in lengths of 10 to 25 feet, is the torque transmitting structural member from the surface rotary power mechanism to the drilling bit at the bottom end of the drilling rod. To each section of outer tube 12 is attached at one end an elongated cylindrical pin, such as pin 14 shown in FIG. 1, and to the opposite end of outer tube 12 is attached box 16 such as shown in FIG. 2 later discussed. The plurality of sections or stands of outer tubes are then joined together by screwing together pins with boxes to form the complete drill rod extending from the ground surface to the drill bit, which may include many sections of outer tubing below the ground surface. Pin 14, which at its greatest circular diameter, is of the same outer cylindrical diameter as the outer cylindrical diameter of outer tube 12, is joined to outer cylindrical tube 12 by encompassing in sleeve like fashion the reduced cylindrical diameter neck position 18 of pin 14, pin 14 just slipping interiorly to the inner diameter of outer tube 12. At the point where the reduced cylindrical diameter neck 18 joins the outer cylindrical surface of pin 14 is sloped shoulder 20. The end of outer tube 12 may also have a sloped shoulder 22 (or it may be square), the pair of shoulders thus forming a v-shaped annular ring which is filled with weld fillet 24, weld fillet 24 fixedly securing pin 14 to the end of outer tube 12.

Pin 14 is characterized by having at its end opposite the end encompassed by outer tube 12, a reduced diameter cylindrical portion with threaded end 26. Pin 14 has an internal cylindrical bore 28 running its complete length. Extending radially inwardly from internal bore 28 are a plurality of protruding lands 32, lands 32 being the means that suspends and aligns inner tube 30 interiorly to the outer tube 12. At least 3 lands are required interiorly to bore 28 to suspend and align inner tube 30. It is anticipated that clearance between the top surface of the lands and the outer cylindrical surface of the inner tube is in the order of 0.01 inch. By this means, if inner tube 30 is residing equally between all lands 32, there will be about 0.02 inch maximum clearance to one point of near contact between the tube and the lands (for 4 lands).

In the reverse circulation drill rod as preferably used, a fluid such as air is forced down the cylindrical space annulus formed between the inner diameter surface of outer tube 12 and the outer diameter surface of inner tube 30, and the compressed air plus drill bit grindings or rock fragments are brought up to the surface of the ground through the conduit afforded by inner tube 30. Air passes through pin 14 via internal cylindrical bore 28, the lands 32 only presenting a partial obstruction since the lands only occupy a small portion of the area between internal bore 28 and the outer surface of inner tube 30. Of course, lands 32 will cause turbulence in the flow of compressed air as it moves from the ground surface to the area of the drill bit. As will be shown later, the inner tubes 30 between adjoining drill rod sections are joined in a butting relationship.

The mechanism by which inner tube 30 is allowed longitudinal freedom (with limits) interiorly to outer tube 12 and connected pin and box at opposite ends of inner tube 12 is shown proximate the end of outer tube 12 at its joinder to pin 14. This means, which allows inner tube 30 to float, but with restrictions, interiorly to outer tube 12 is compression spring 34 which is fixedly attached to the exterior surface of inner tube 30 by means of lug 36. It is noted that while the pin end has been shown in cross-sectional view, the spring 34 and lug 36 have been shown in plan view for ease of understanding. Lug 36, which is attached by welding to spring 34, is also welded to the outside of inner tube 30. Spring 34, which in the preferred embodiment comprises only one to two coils, is a loose wound spring having an outer coil diameter the same size (or slightly smaller) as the inside diameter of outer tube 12. Spring 34 abuts the joinder of outer tube 12 and the end of pin 14 so that, in the view shown in FIG. 1, spring 34 is just started being compressed and thus would be urging inner tube 30 to the left of pin 14. Thus, the lengthwise floating action of inner tube 30 interiorly to outer tube 12 and pin 14. Inner tube 30 is suspended concentrically to outer tube 12 by means to lands 32 attached to pin 14 (although some help may be offered by spring 34), which also aligns inner tube 30 for its mating with the inner tube in the next adjacent drill rod section.

At the opposite box end of outer tube 12 is a second inner tube floating mechanism, although, since it is obvious that spring 34 attached to inner tube 30 at the pin end allows back and forth longitudinal movement of inner tube 30 within outer tube 12, it would be conceivable to do away with one of the two spring mechanisms and only employ one mechanism per length of inner tube. Also, as it is obvious from the drawing in FIGS. 1 and 2, inner tube 30 will be of a length longer than outer tube 12, that extra length necessary because of the added length given outer tube 12 by the addition of pin 14 and box 16.

FIG. 2 is a cross-sectional view of outer tube 12 at the end opposite the end having attached pin 14. At this end of outer tube 12 is attached box 16. Box 16 is adapted to mate with pin 14 of FIG. 1 until pin 14 completely seats within box 16 in order that rotational torque may be applied to the multiple lengths of outer tube 12. Box 16 attaches to outer tube 12 by means of a reduced diameter cylindrical neck 38 which resides interiorly to the end of outer tube 12 until the end of outer tube 12 contacts the beveled or sloped shoulder 40 of box 16. The triangular or "V-shaped" annular furrow formed between the end of outer tube 12 and beveled shoulder 40 is filled with weld fillet 42, the means by which box 16 is permanently attached to outer tube 12.

As mentioned earlier, pin 14 threads into box 16 and does so by means of internal threads 44 formed on the internal cylindrical bore 47 cavity at the outside end of box 16. Threads 44 are terminated at angular wall 46 which receives the annular rim surface 25 of threaded end 26 of pin 14 (FIG. 1.). Internally to box 16 is inner tube 30 which is adapted to butt mate with the end of the adjacent section of inner tubing protruding into the cavity formed in pin 14. Suspension and alignment of tubing 30 in its concentric location interiorly to the cylindrical internal bore 47 of box 16 is accomplished by lands 48, and inner tube 30 is further held from substantial lengthwise travel by means of compression spring 50. Similarly as with compression spring 34 situated at pin 14, compression spring 50 has one of its coils urged up against the joinder of outer tube 12 and the end of box 16, and the other end of its coils attached to lug 52, lug 52 in turn welded to the outside cylindrical surface of inner tube 30. Like the spring and lug of FIG. 1, spring 50 and lug 52 are shown in plan view for ease of understanding.

It is obvious from the FIGS. 1 and 2 that inner tube 30 then is capable of floating, with limitations, interiorly to outer tube 12 and pin 14 and box 16. It is also apparent that inner tube 30 need not be of exact precision length relative to outer tube 12 and pin 14 and box 16. While springs 34 and 50 will allow movement to compensate for slightly varying lengths of inner tube 30 as the outer tube sections are joined together and the combined weight of many stacked inner tubes cause the tubes to come together, yet, it is apparent that after many lengths of outer tube sections, any errors in length of the inner tube will be accumulative with the shortness of one inner tube compensating for the excessive-length of another inner tube. Nevertheless, it is conceivable that the requirement for movement of inner tube 30 within outer tube 12 due to the accumulation of too many short (or long) inner tubes exceeds the ability of lengthwise movement afforded by springs 34 and 50. However, this will be discovered at the ground surface when assembling the drill rod sections in its vertical position and may be compensated by the addition of a purposely short (or long) inner tube in the following drill rod section.

Figure 3:
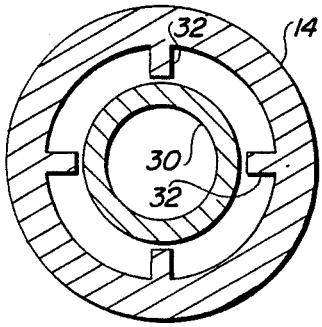
FIG. 3 is a cross-sectional view taken through sectional lines 3—3 of the pin shown in FIG. 1.

Referring now to FIG. 3, a sectional view is shown taken along sectional line 3—3 of FIG. 1. Here are primarily shown the relationship of the inner tube with the lands interiorly to pin 14. Shown in FIG. 3, commencing from the outside, is pin 14 having attached to it, in this case, four lands 32, the lands extending radially inward to the vicinity of inner tube 30. Inner tube 30 will, in most probability, touch one or two of the lands although it will not be confined to a touching operation. In practice, the best and preferred orientation is that it will be centered between all of the lands.

By way of illustration, in the two most common instances of drilling rod, i.e., 3.5 and 4.5 inch, pin 14 has an outer diameter of 3.5 and 4.5 inches respectively, an inner diameter as taken through section line 3—3 of 2.75 and 3.75 inches respectively, and a length of 8 and 11 inches respectively. The inner tube has an outer diameter of 2 and 3 inches respectively and an inner diameter of 1.5 and 2.5 inches respectively. Since air, together with drill bit grindings or rock fragments, are brought up through the interior of inner tube 30, typically the inner tube has a wall thickness of 0.25 inches for both cases, and the outer tube wall a thickness 0.188 and 0.25 inches respectively. Except in the case of the larger drill rod, which is needed for strength, the outer tube wall thickness is not as thick as the inner tube wall thickness inasmuch as air passes internally to it while the drill bit grindings and rock fragments tend to wear away the inner surface of inner tube 30.

Figure 4:
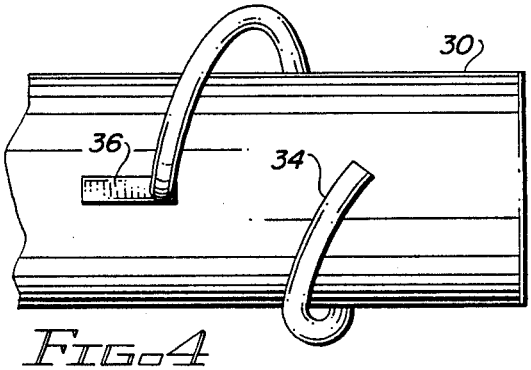
FIG. 4 is a side view of the inner tube showing connection of the compression spring.

FIG. 4 is a side view of inner tube 30 with one of the compression springs utilized attached to it, for convenience, compression spring 34 is shown encircling inner tube 30 slightly over one coil. Spring 34 is permanently attached to the exterior surface of inner tube 30 at the point of lug 36, lug 36 being welded to the inner tube 30. The coil diameter of spring 34 is set to be the same size or slightly smaller than the inner diameter of outer tube 12.

Figure 5:
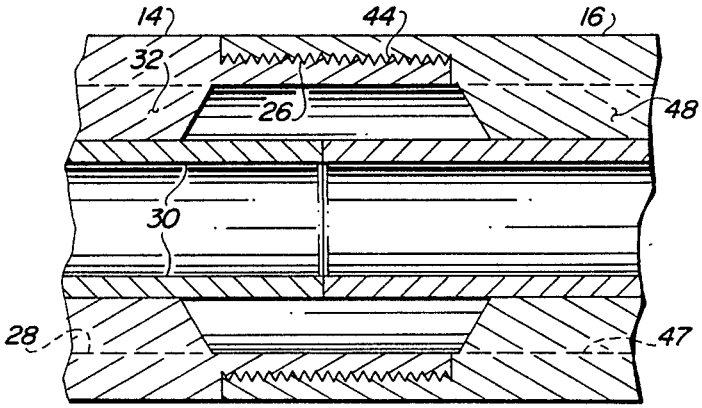
FIG. 5 is a cross-sectional view of two reverse circulation drill rod sections joined together.

Lastly, FIG. 5 shows a cross-sectional view of a portion of the subject invention in operation where multiple stands or sections of the drill rod have been connected. In the illustration of FIG. 5, only portions of the pin and the box is shown, together with their mating. Outer tubes 12 on either side of the box and the pin are not shown. As seen in FIG. 5, pin 14 is mated to box 16 by means of the screw threads 26 attached to the threaded end of pin 14 and the screw threads 44 formed in the cylindrical cavity of box 16. Internal bore 28 of pin 14 is shown in dotted form as is internal bore 47 of box 16. Centrally located to the connection shown in FIG. 5 are the two inner tubes 30, the tubes precision square cut for butt ending centrally to the threaded area.

While a preferred embodiment of the invention has been shown and described, it will be appreciated that there is no intent to limit the invention by such disclosure. Accordingly, the disclosure is intended to cover all modifications and alternate embodiments falling with in the spirit and the scope of the invention as defined with in the appended claims.

I claim:

1. In a reverse circulation drill rod of the dual tube type providing for passage of fluid down through the drill rod in one direction and for up return of the fluid, together with drill cuttings or rock fragments in the other direction, the drill rod consisting of connected multiple identical sections, a drill rod section comprising:

an elongated cylindrical outer tube having a first end and a second end;

an elongated cylindrical pin operably attached to said outer tube first end, said pin having an outer cylindrical surface with internal circular bore therethrough and a plurality of spaced apart radially directed inwardly protruding lands attached to said internal bore, said lands having end surfaces;

an elongated cylindrical box operably attached to said outer tube second end, said box having an outer cylindrical surface with internal circular bore therethrough and a plurality of spaced apart radially directed inwardly protruding lands attached to said internal bore, said lands having end surfaces;

an inner tube situated concentrically interiorly to and operably attached to said outer tube, pin, and box, said inner tube having limited longitudinal freedom of movement within said outer tube, pin, and box, said elongated cylindrical pin and elongated cylindrical box plurality of protruding lands end surfaces adapted to receive, secure, and align said inner tube situated concentrically interiorly of said pin and said box for connection to adjacent sections; and means limiting the freedom of longitudinal movement of said inner tube within said outer tube, said means including a first coil spring having two ends, one end of which is operably attached to said inner tube and the second end is juxtaposed said pin and said outer tube whereby said inner tube may move longitudinally relative to said outer tube, pin, and box when connecting multiple sections of said drill rod, said pin of one section connective to said box of the adjacent section, the passage of fluid down through the drill rod passes through the cylindrical annulus formed between the outer tube and the inner tube, and between said pin internal circular bore lands and said inner tube, and the up return of the fluid, drill cuttings or rock fragments, passed through the inner tube.

2. The section of reverse circulation drill rod as defined in claim 1 wherein said means limiting longitudinal freedom of movement of said inner tube additionally includes a lug attached to said inner tube, said lug also attached to one end of said spring whereby said coil spring is held to said inner tube by its attachment to said lug.

3. The section of reverse circulation drill rod as defined in claim 2 wherein said inner tube has an elongated cylindrical exterior surface of a first fixed diameter, and the end surfaces of said lands define a circle of a second fixed diameter, said lands circle second diameter greater than said inner tube exterior surface first fixed diameter by 0.020 inch.

4. The section of reverse circulation drill rod as defined in claim 3 wherein said elongated cylindrical pin has a first end and a second end, said first end defining a reduced diameter cylindrical neck connective with said pin outer cylindrical surface, said neck adapted to receive for attachment said first end of said outer tube in a sleeve type arrangement.

5. The section of reverse circulation drill rod as defined in claim 4 wherein said elongated cylindrical pin second end defines a reduced diameter cylindrical portion connective with said pin outer cylindrical surface, said cylindrical portion having a plurality of male threads thereupon.

6. The section of reverse circulation drill rod as defined in claim 5 wherein said inner tube defines a tube having a first end and a second end with a cylindrical axis, said first and second ends having a flat circular rim surface, said flat rim surface at right angles to the cylindrical axis of said inner tube whereby inner tubes of multiple sections the sections are connected.

7. The section of reverse circulation drill rod as defined in claim 6 wherein said means limiting longitudinal freedom of said inner tube includes a second coil spring having two ends, one end of which is operably attached to said inner tube and the second end of which is situated juxtaposed said box and said outer tube.

8. The section of reverse circulation drill rod as defined in claim 7 wherein said elongated cylindrical box has a first end and a second end, said first end defining a reduced diameter cylindrical neck connective with said pin outer cylindrical surface, said neck adapted to receive for attachment said second end of said outer tube in a sleeve type arrangement.

9. The section of reverse circulation drill rod as defined in claim 8 wherein said elongated cylindrical box second end defines a cylindrical cavity, said cylindrical cavity having a plurality of female threads therein, said pin male threads adapted to join with said box female threads when sections of said drill rod are connected together, said flat circular rim surface of said inner tubes of adjacent sections butt-mating together.

10. The section of reverse circulation drill rod as defined in claim 9 wherein said first and second coil springs have a coil diameter, said coil diameter less than said diameter of said neck of said pin and said box.

11. The section of reverse circulation drill rod as defined in claim 10 wherein said first and second coil springs have between 1 and 2 turns of said coil.

* * * * *

UNITED STATES PATENT AND TRADEMARK OFFICE

CERTIFICATE OF CORRECTION

PATENT NO. : 4,940,098

DATED : July 10, 1990

INVENTOR(S) : Daniel H. Moss

It is certified that error appears in the above-identified patent and that said Letters Patent is hereby corrected as shown below:

Column 9, line 11 (Claim 6), after "sections", insert --butt-mate when--.

Signed and Sealed this

Twenty-second Day of December, 1992

*Attest:*

DOUGLAS B. COMER

*Attesting Officer*

*Acting Commissioner of Patents and Trademarks*